United States Patent [19]

Manz

[11] Patent Number: 5,042,271

[45] Date of Patent: Aug. 27, 1991

[54] REFRIGERANT HANDLING SYSTEM WITH COMPRESSOR OIL SEPARATION

[75] Inventor: Kenneth W. Manz, Paulding, Ohio

[73] Assignee: Kent-Moore Corporation, Warren, Mich.

[21] Appl. No.: 468,068

[22] Filed: Jan. 22, 1990

[51] Int. Cl.[5] ..... F25B 43/02

[52] U.S. Cl. ..... 62/473; 62/84; 62/470

[58] Field of Search ..... 62/292, 85, 149, 503, 62/473, 470, 84, 472

[56] References Cited

U.S. PATENT DOCUMENTS

| | | | |
|---|---|---|---|
| 3,324,680 | 6/1967 | Cremer | 62/473 |
| 3,850,009 | 11/1974 | Villadsen | 62/473 |
| 4,646,527 | 3/1987 | Taylor | 62/292 X |
| 4,862,699 | 9/1989 | Lounis | 62/292 X |

*Primary Examiner*—Henry A. Bennet

*Attorney, Agent, or Firm*—Barnes, Kisselle, Raisch, Choate, Whittemore & Hulbert

[57] ABSTRACT

A refrigerant handling system that includes a compressor having an inlet and an outlet, a condenser for withdrawing heat from and at least partially condensing refrigerant passing therethrough, and a compressor oil separator connected between the compressor outlet and the condenser for separating oil from refrigerant passing to the condenser. The compressor oil separator takes the form of a closed canister having an open internal volume, a vapor inlet and a vapor outlet at an upper portion of the canister, and an oil drain at a lower portion of the canister. A refrigerant coil is mounted externally of the canister in heat exchange relationship with the canister sidewall. The vapor inlet, vapor outlet and refrigerant coil are connected in series between the compressor outlet and the condenser coil such that heat of refrigerant passing through the coil heats the canister internal volume to prevent condensation of refrigerant therein.

27 Claims, 2 Drawing Sheets

REFRIGERANT HANDLING SYSTEM WITH COMPRESSOR OIL SEPARATION

The present invention is directed to a compressor system for pumping fluid such as refrigerant vapor, and more particularly to a refrigerant handling system with improved facility for removing compressor oil from refrigerant at the compressor outlet.

BACKGROUND AND OBJECTS OF THE INVENTION

U.S. Pat. Nos. 4,768,347 and 4,805,416, both assigned to the assignee hereof, disclose refrigerant handling systems that include a compressor having an inlet coupled to a refrigerant source, such as refrigeration equipment from which refrigerant is to be recovered, and an outlet coupled through a condenser to a refrigerant storage container. It is required by SAE standards that oil contamination in refrigerant pumped into the storage container for later purification and reuse be limited to less than 4,000 ppm. ASHRAE and ARI standards are similar but more stringent. It is therefore desirable not only to remove oil from refrigerant at the compressor outlet, but also to return this oil to the compressor sump to avoid or minimize service addition of oil to the compressor sump or repair of damage to the compressor due to lack of proper lubrication.

It has heretofore been proposed to employ a metal canister having an open internal volume coupled to the compressor outlet so that refrigerant vapor loses velocity within the canister and oil droplets fall by gravity to the lower portion of the canister. However, hot refrigerant vapor from the compressor outlet, contacting the cooler metal wall of the canister, causes condensation of refrigerant and interferes with proper oil separation. Typically, the oil separator has therefore been provided with a blanket heater to heat the canister walls in an effort to avoid refrigerant condensation within the canister. A float valve at the lower portion of the canister returns collected oil to the compressor inlet.

It is also been found desirable, upon termination of compressor operation, to bleed refrigerant from the compressor outlet or discharge line to the compressor inlet or suction line in order to pressurize the system oil separator at the compressor inlet, to provide for proper draining of collected oil, and also to ease subsequent starting of the compressor. However, it is necessary to limit the amount of refrigerant bled to the low-pressure side of the compressor to avoid condensation of refrigerant and prevent "slugging" upon subsequent compressor operation.

It is therefore a general object of the present invention to provide a compressor oil separation system that finds particular utility in refrigerant handling systems such as refrigerant recovery, purification and recharging systems of the character disclosed in the aforementioned patents, that addresses the aforementioned needs and deficiencies of prior art systems, that is economical to manufacture, that provides reliable service over an extended operating lifetime, and in which the compressor oil separator contains no moving parts. In this connection, it is a more specific object of the invention to provide a compressor oil separator that eliminates the need for the electric heater blanket heretofore employed in the art to prevent condensation of refrigerant in the oil separator, with consequent reduction in assembly and operating costs.

SUMMARY OF THE INVENTION

A refrigerant handling system in accordance with the present invention includes a compressor having an inlet and an outlet, a condenser for withdrawing heat from and at least partially condensing refrigerant passing therethrough, and a compressor oil separator connected between the compressor outlet and the condenser for separating oil from refrigerant passing to the condenser. The compressor oil separator takes the form of a closed canister having an open internal volume, a vapor inlet and a vapor outlet at an upper portion of the canister, and an oil drain in the canister. A refrigerant coil extends in heat exchange relationship with refrigerant within the canister volume. The vapor inlet, vapor outlet and refrigerant coil are connected in series, preferably in the order stated, between the compressor outlet and the condenser coil such that heat of refrigerant passing through the coil heats the canister internal volume to prevent condensation of refrigerant therein.

In one preferred embodiment of the invention, the canister has a substantially cylindrical sidewall of heat conductive construction, and the refrigerant coil comprises a helical coil mounted in heat-exchange relationship with the sidewall externally of the canister. The canister oil drain is positioned at a lower portion of the canister, and is connected to the compressor inlet through a capillary line that returns oil collected within the canister to the compressor inlet and thence to the compressor oil sump. The capillary line also functions to pressurize the system oil separator at the compressor inlet, and to equalize pressure between the compressor outlet and the compressor inlet to facilitate subsequent starting of the compressor.

In another embodiment of the invention, the canister is internally equipped with a conventional float-type valve that is responsive to oil level within the canister to open a drain in the canister bottom and return refrigerant to the compressor inlet. In a third embodiment of the invention, the canister drain takes the form of a J-shaped tube disposed within the canister and having a side wall opening at the lower portion of the tube for aspirating oil from the canister into refrigerant passing through the tube. The tube outlet at the canister top is connect through a manual valve to the compressor inlet. In both of the second and third embodiments, the compressor inlet takes the form of a split inlet, with the refrigerant evaporator being connected to the upper inlet and the canister drain being connected to the lower inlet.

BRIEF DESCRIPTION OF THE DRAWINGS

The invention, together with additional objects, features and advantages thereof, will be best understood from the following description, the appended claims and the accompanying drawing in which:

DETAILED DESCRIPTION OF PREFERRED EMBODIMENT

Figure 1:
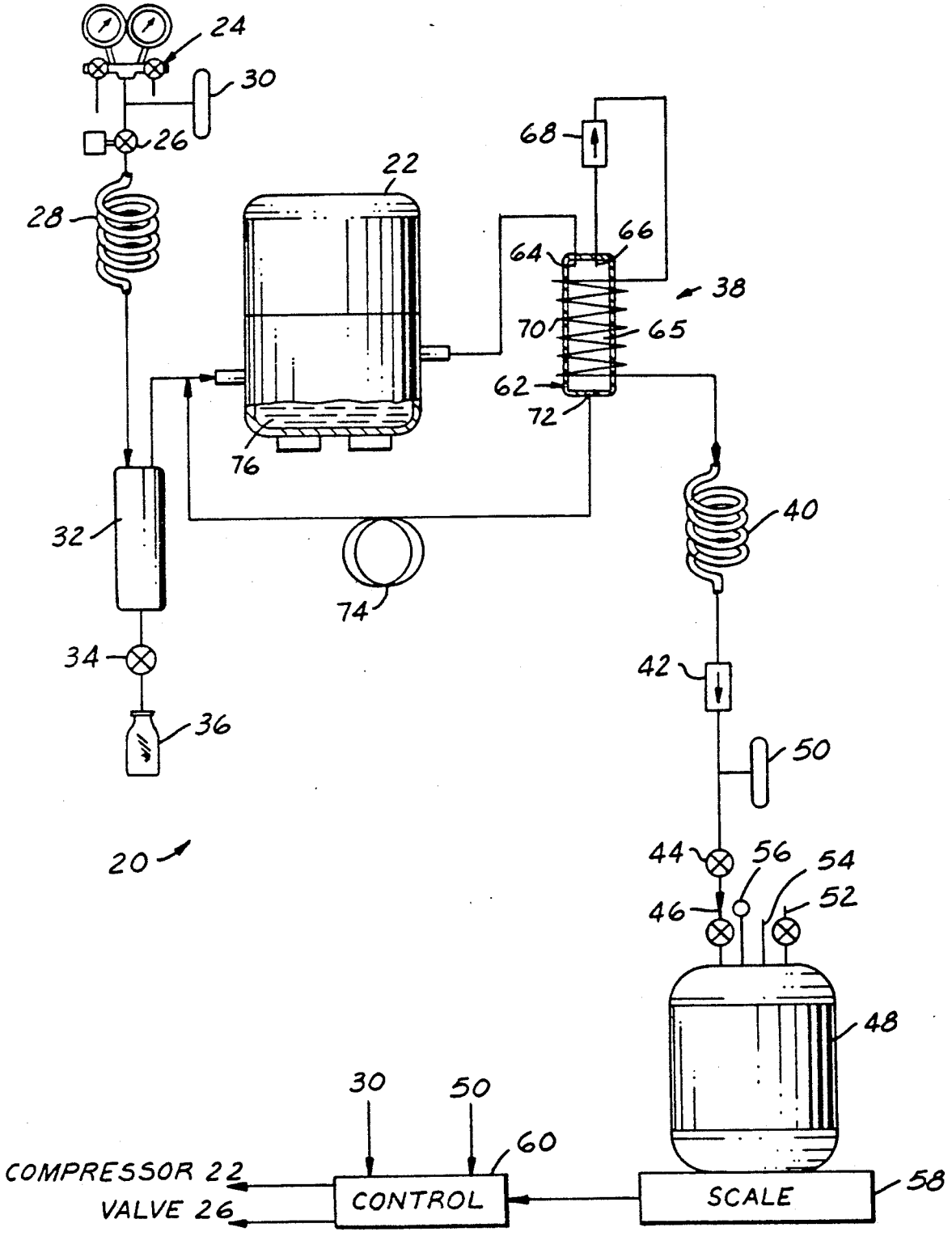
FIG. 1 is a schematic diagram of a refrigerant recovery system in accordance with one presently preferred embodiment of the invention.

FIG. 1 illustrates a refrigerant recovery system 20 in accordance with one presently preferred embodiment of the invention as comprising a compressor 22 having an inlet that is coupled to an input manifold 24 through a solenoid valve 26 and an evaporator 28 for adding heat to refrigerant passing therethrough and thereby insuring that refrigerant at the inlet of compressor 22 is in substantially vapor phase. Manifold 24 includes facility of connection to the high-pressure and low-pressure sides of a refrigeration system from which refrigerant is to be recovered. Manifold 24 also includes the usual manual valves and pressure gauges. A pressure switch 30 is connected between solenoid valve 26 and manifold 24, and is responsive to a predetermined low-pressure to the compressor inlet from the refrigeration system under service to indicate removal or recovery of refrigerant therefrom. A system oil separator 32 is connected between evaporator coil 28 and the inlet of compressor 22 for removing oil from input refrigerant vapor, and a valve 34 is coupled to separator 32 for draining oil removed from refrigerant into a catch bottle 36.

The outlet of compressor 22 is connected through a compressor oil separator 38 to a condenser coil 40 for extracting heat from and at least partially condensing refrigerant passing therethrough. The outlet side of condenser coil 40 is connected through a check valve 42 and a manual valve 44 to the vapor port 46 of a refrigerant storage container 48. A high-pressure sensor switch 50 is connected between check valve 42 and manual valve 44. Container 48 also includes the usual liquid port 52, vent 54 and gauge 56. Preferably, although not necessarily, condenser coil 40 and evaporator coil 28 ma be provided in the form of a single heat exchange assembly. Container 48 is carried by a scale 58 that provides an electronic signal to a control electronics package 60 indicating weight of refrigerant in container 48 and/or impending overfill of the container. Control electronics 60 also receives input signals from pressure sensors 30,50, and provides output signals to operate compressor 22 and solenoid valve 26. With the exception of compressor oil separator 38, refrigerant recovery system 20 to the extent thus far described is similar to those disclosed in the above-noted U.S. patents, to which reference may be had for more detail discussion of structure and operation.

Oil separator 38, which characterizes the present invention, comprises a closed canister 62 having a substantially cylindrical sidewall and axially opposed top and bottom walls. At least the canister sidewall, and preferably the entire canister, is of heat conductive construction such as sheet metal. A vapor inlet port 64 is positioned in the canister top wall at the upper portion of the internal canister volume 65, and is connected to the outlet of compressor 22. A vapor outlet port 66 is likewise positioned at the upper portion of the canister volume, and is connected through a check valve 68 to a helical coil 70 externally mounted on the sidewall of canister 62 in heat exchange relationship therewith throughout substantially the entire length of the canister. The opposing end of coil 70 is connected to condenser coil 40. An open oil drain port 72 is positioned at the lower portion of canister 62 and connects the internal canister volume 65 through a capillary tube 74 to the inlet of compressor 22.

In operation, hot refrigerant vapor from the outlet of compressor 22 is fed through canister 62 to and through coil 70, which thus heats the walls of the canister to prevent condensation of refrigerant vapor within canister 62, which might otherwise occur through contact with cool canister walls. Coil 70 thus replaces the electrically operated heating blanket typical of prior art compressor oil separator constructions. Velocity of refrigerant vapor is reduced during passage through canister 62, permitting oil droplets to fall and collect in the lower portion of the canister. Such collected oil is returned through capillary tube 74 to the internal sump 76 of compressor 22 by cooperation of high-pressure refrigerant within canister 62 and low-pressure suction at the compressor inlet. However, capillary tube 74 presents sufficient restriction to minimize direct passage of refrigerant vapor to the compressor inlet in the absence of oil collected in canister 62. When compressor 22 is shut down by control electronics 60, either at the end of a recovery operation or upon an indication of impending overfill of container 48, capillary tube 74 functions over time to equalize pressure across the compressor between the inlet and outlet. This facilitates restarting of the compressor in a subsequent recovery operation. Capillary tube 74 also facilitates pressurization of system oil separator 32, while check valve 68 prevents reverse flow of refrigerant from condenser 40 and container 48 to the compressor inlet.

Figure 2:
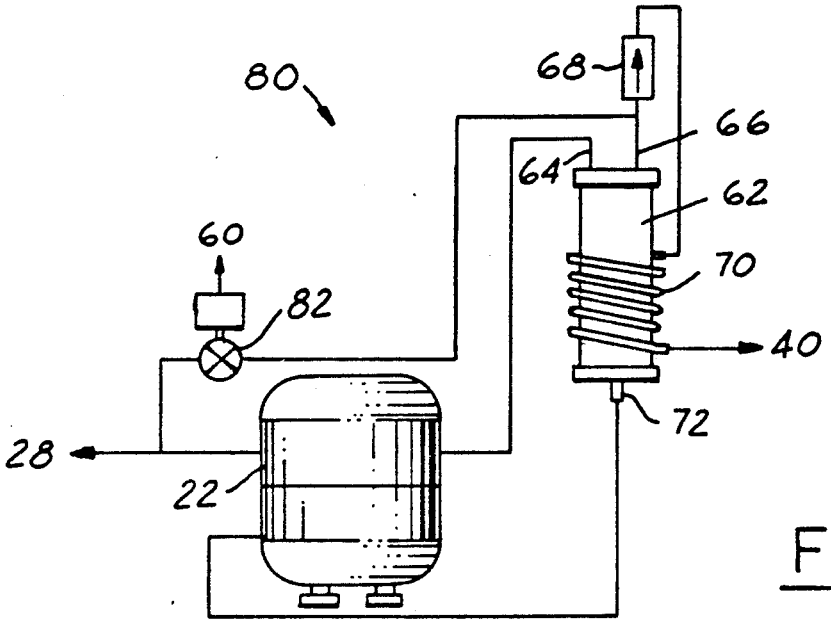
FIG. 2 is a fragmentary schematic diagram that illustrates a second preferred embodiment of the invention.

FIG. 2 is a fragmentary schematic diagram that illustrates a compressor oil separation system 80 in accordance with a second embodiment of the invention. Compressor 22 is a split-inlet type compressor, having a upper inlet connected to evaporator coil 28 and a lower inlet directly connected to canister drain 72. A conventional float-type valve (not shown) is contained within canister 62, and is responsive to level of oil collected at the lower portion of canister 62 for opening drain 72 and returning the oil to the lower inlet of compressor 22. Outlet port 66 of canister 62 is connected to the upper inlet of compressor 22 by a solenoid valve 82 for selectively equalizing pressure across the compressor to ease compressor starting. Solenoid valve 82 is normally open when compressor 22 is idle, and is closed automatically by control electronics 60 (FIG. 1) a short time after compressor operation is initiated.

Figure 3:
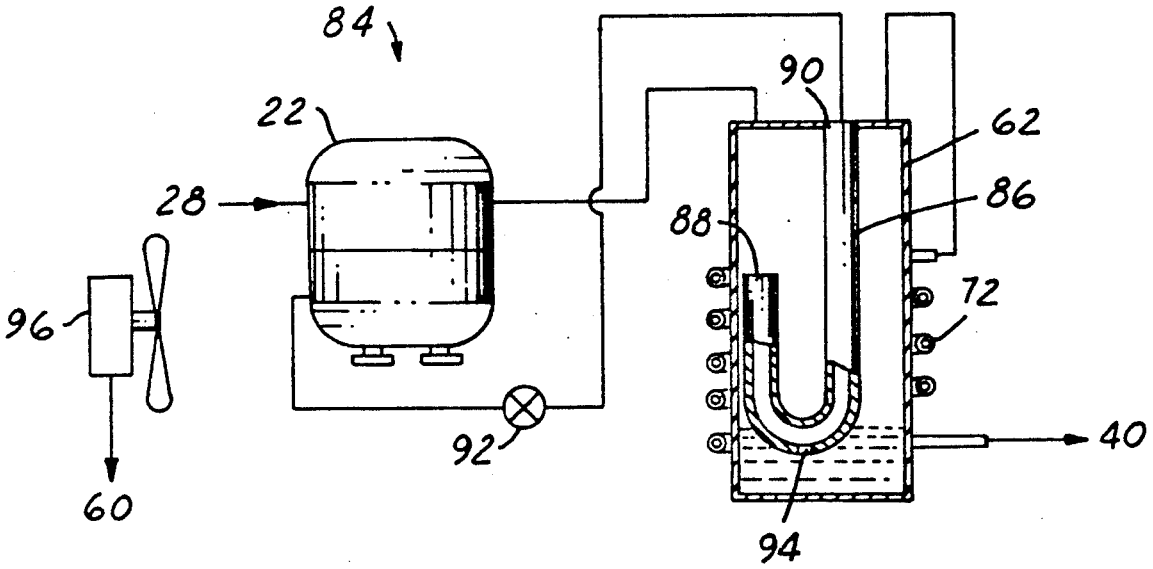
FIG. 3 is a fragmentary schematic diagram that illustrates a third embodiment of the invention.

FIG. 3 illustrates a compressor oil separator system 84 in accordance with a third embodiment of the invention. The oil drain in the embodiment of FIG. 3 comprising a J-shaped tube 86 that has one open end 88 positioned axially about midway between the top and bottom of canister 62, and second open end 90 connected by a manual valve 92 to the lower inlet of compressor 22. An opening 94 is provided at the lower portion of tube 86 so as to be immersed in oil collected at the bottom of canister 62. To return oil from canister 62 to the sump 76 (FIG. 1) of compressor 22, manual valve 92 is opened by the operator. Pressure across tube 86 draws refrigerant from within canister 62 through valve 92 to the compressor inlet, which aspirates oil through opening 94. A fan 96 is positioned to blow cooling air over compressor 22 and canister 62, and is electrically connected to control electronics 60 (FIG. 1).

There is thus provided a refrigerant handling system that fully satisfies all of the objects and aims previously set forth. It will be appreciated that, although the invention has been disclosed in conjunction with a refrigerant recovery system, the invention may be employed equally as well in other types of refrigerant handling systems, such as refrigerant purification systems of the type disclosed in above-noted U.S. Pat. No. 4,805,416, as well as in air conditioning systems, heat pump systems and the like.

I claim:

1. A refrigerant handling system that includes a compressor having an inlet and an outlet, condenser means for withdrawing heat from and at least partially condensing refrigerant passing therethrough, means connecting said condenser means to said compressor outlet forming a refrigerant flow path through said compressor, and means connected between said compressor outlet and said condenser means for separating oil from refrigerant passing to said condenser means, said oil-separating means comprising:

a closed canister having an open internal volume and a canister wall of heat conductive construction, coil means extending in heat exchange relationship with said canister wall, a vapor inlet and a vapor outlet at an upper portion of said canister, means connecting said compressor outlet to said vapor inlet, means connecting said vapor outlet to said coil means and means connecting said coil means to said condenser means such that refrigerant from said compressor outlet flows in series through said internal volume and then through said coil means to said condensing means and heat of refrigerant flowing through said coil means heats said canister wall to prevent condensation of refrigerant on said canister wall within said volume, and an oil drain in said canister.

2. The system set forth in claim 1 wherein said canister wall is of substantially cylindrical construction, and wherein said coil means extends in heat exchange relationship said canister wall substantially throughout the length of said canister.

3. The system set forth in claim 1 wherein said canister has a substantially cylindrical sidewall, and wherein said coil means is mounted on said sidewall externally of said canister in heat exchange relationship with said sidewall.

4. The system set forth in claim 1 wherein said means connecting said vapor outlet to said coil means includes a check valve.

5. The systems set forth in claim 1 further comprising means coupled to said drain for removing oil from said canister.

6. The system set forth in claim 5 wherein said compressor has an oil sump for lubricating operation of said compressor, and wherein said oil-removing means comprises means connecting said drain to said compressor inlet for returning oil from said canister to said sump.

7. The system set forth in claim 6 wherein said oil-returning means comprises a direct open connection between said drain and said compressor inlet, and means forming a restriction in said connection such that oil collected in said canister is drawn to said compressor inlet without substantial removal of refrigerant from said canister.

8. The system set forth in claim 7 wherein said restriction forming means comprises a capillary line in said connection.

9. The system set forth in claim 7 further comprising a check valve for preventing reverse flow of refrigerant through said oil-separating means.

10. The system set forth in claim 6 wherein said drain comprises a J-shaped tube positioned within said canister, said tube having an opening at a lower portion thereof for aspirating oil into refrigerant passing through said tube, and wherein said drain-connecting means includes a valve for selectively connecting said tube to said compressor inlet.

11. The system set forth in claim 6 wherein said compressor inlet comprises a split inlet, said evaporator coil being connected to one said inlet and said drain being connected to the other said inlet.

12. A refrigerant handling system that includes a compressor having an inlet, an outlet and an internal oil sump for lubricating operation of said compressor, condenser means for withdrawing heat from and at least partially condensing refrigerant passing therethrough, means connection said condenser means to said compressor outlet forming a refrigerant flow path through said compressor, and means connected between said compressor outlet and said condenser means for separating oil from refrigerant passing to said condenser means and returning separated oil to said compressor sump, said oil-separating means comprising:

a closed canister having a cylindrical wall of heat conductive construction and an open internal volume, a refrigerant coil mounted on said wall externally of said canister in heat exchange relationship with said wall, a vapor inlet and a vapor outlet in an upper portion of said canister, means connecting said compressor outlet to said vapor inlet, means connecting said vapor outlet to said coil means, means connecting said coil means to said condenser means such that refrigerant from said compressor outlet flows in series through said internal volume and then through said coil means to said condenser means and heat of refrigerant flowing through said coil means heats said canister wall to prevent condensation of refrigerant on said canister wall within said volume, an oil drain in said canister, and means connecting said drain to said compressor inlet for returning oil from said canister to said sump.

13. The system set forth in claim 12 wherein said oil-returning means comprises a direct open connection between said drain and said compressor inlet, and means forming a restriction in said connection such that oil collected in said canister is drawn to said compressor inlet without substantial removal of refrigerant from said canister.

14. The system set forth in claim 13 wherein said restriction forming means comprises a capillary line in said connection.

15. The system set forth in claim 12 wherein said means connecting said vapor outlet to said coil means comprises a check valve.

16. The system set forth in claim 12 wherein said coil means compresses a helical coil that extends along said wall.

17. The system set forth in claim 13 wherein said drain comprises a J-shaped tube positioned within said canister, said tube having an opening at a lower portion thereof for aspirating oil into refrigerant passing through said tube, and wherein said drain-connecting means includes a valve for selectively connecting said tube to said compressor inlet.

18. A compressor system for pumping a fluid comprising:

a compressor having an inlet, an outlet and an internal oil sump for lubricating operation of said compressor, and means connected to said compressor outlet for removing oil from fluid at said outlet, said oil-separating means comprising:

a closed canister having a cylindrical wall of heat conductive construction and an open internal volume, a helical fluid coil mounted to said wall externally of said canister in heat exchange relationship with said wall and extending along said wall substantially throughout the length of said wall, a vapor inlet and a vapor outlet in an upper portion of said canister, means connecting said compressor outlet to said vapor inlet and means connecting said vapor outlet to said coil means such that refrigerant from said compressor outlet flows in series through said internal volume and then through said coil, an oil drain at a lower portion of said canister, and means connecting said drain to said compressor inlet for returning oil from said canister to said sump.

19. The system set forth in claim 18 wherein said oil-returning means comprises a direct open connection between said drain and said compressor inlet, and means forming a restriction in said connection such that oil collected in said canister is drawn to said compressor inlet without substantial removal of refrigerant from said canister.

20. The system set forth in claim 19 wherein said restriction-forming means comprises a capillary line in said canister.

21. The system set forth in claim 20 further comprising a check valve for preventing reverse flow of refrigerant through said oil-separating means.

22. A refrigerant handling system that includes a compressor having an inlet and an outlet, condenser means for withdrawing heat from and at least partially condensing refrigerant passing therethrough, means connecting said condenser means to said compressor outlet forming a refrigerant flow path through said compressor, and means connected between said compressor outlet and said condenser means for separating oil from refrigerant passing to said condenser means, said oil-separating means comprising:

a closed canister having an open internal volume, coil means extending in heat exchange relationship with refrigerant within said canister volume, a vapor inlet and a vapor outlet at an upper portion of said canister, means connecting said compressor outlet to said vapor inlet, means including a check valve connecting said vapor outlet to said coil means and means connecting said coil means to said condenser means such that heat of refrigerant flowing through said coil means heats said canister internal volume to prevent condensation of refrigerant therein, and an oil drain in said canister.

23. A refrigerant handling system that includes a compressor having an inlet, an outlet and an oil sump for lubricating operation of said compressor, condenser means for withdrawing heat from and at least partially condensing refrigerant passing therethrough, means connecting said condenser means to said compressor outlet forming a refrigerant flow path through said compressor, and means connected between said compressor outlet sand said condenser means for separating oil from refrigerant passing to said condenser means, said oil-separating means comprising:

a closed canister having an open internal volume, coil means extending in heat exchange relationship with refrigerant within said canister volume, a vapor inlet and a vapor outlet at an upper portion of said canister, means connecting said compressor outlet to said condenser means through said vapor inlet, said vapor outlet and said coil means in series such that heat of refrigerant flowing through said coil means heats said canister internal volume to prevent condensation of refrigerant therein, an oil drain in said canister, and means coupled to said drain for removing oil from said canister including a direct open connection between said drain and said compressor inlet, and a capillary line in said connection such that oil collected in said canister is drawn to said compressor inlet without substantial removal of refrigerant from said canister.

24. A refrigerant handling system that includes a compressor having an inlet, an outlet, and an oil sump for lubricating operation of said compressor, condenser means for withdrawing heat from and at least partially condensing refrigerant passing therethrough, means connecting said condenser means to said compressor outlet forming a refrigerant flow path through said compressor, and means connected between said compressor outlet and said condenser means for separating oil from refrigerant passing to said condenser means, said oil separating means comprising:

a closed canister having an open internal volume, coil means extending in heat exchange relationship with refrigerant within said canister volume, a vapor inlet and a vapor outlet at an upper portion of said canister, means connecting said compressor outlet to said condenser means through said vapor inlet, said vapor outlet and said coil means in series such that heat of refrigerant flowing through said coil means heats said canister internal volume to prevent condensation of refrigerant therein, and an oil drain in said canister, and means coupled to said drain for removing oil from said canister, said drain comprising a J-shaped tube positioned within said canister, said tube having an opening at a lower portion thereof for aspirating oil into refrigerant passing through said tube, said drain-connecting means including a valve for selectively connecting said tube to said compressor inlet.

25. A refrigerant handling system that includes a compressor having an inlet, an outlet and an internal oil sump for lubricating operation of said compressor, condenser means for withdrawing heat from and at least partially condensing refrigerant passing therethrough, means connecting said condenser means to said compressor outlet forming a refrigerant flow path through said compressor, and means connected between said compressor outlet and said condenser means for separating oil from refrigerant passing to said condenser means and returning separated oil to said compressor sump, said oil-separating means comprising:

a closed canister having a cylindrical wall of heat conductive construction and an open internal volume, a refrigerant coil mounted one said wall externally of said canister in heat exchange relationship with said wall, a vapor inlet and a vapor outlet in an upper portion of said canister, means connecting said compressor outlet to said condenser means through said vapor inlet, said vapor outlet and said coil means in series, an oil drain in said canister, a direct open connection between said drain and said compressor inlet for returning oil from said canister to said sump, and a capillary line in said connection such that oil collected in said canister is drawn to said compressor inlet without substantial removal of refrigerant from said canister.

26. A refrigerant handling system that includes a compressor having an inlet, an outlet and an internal oil sump for lubricating operation of said compressor, condenser means for withdrawing heat from and at least partially condensing refrigerant passing therethrough, means connecting said condenser means to said compressor outlet forming a refrigerant flow path through said compressor, and means connected between said compressor outlet and said condenser means for separating oil from refrigerant passing to said condenser means and returning separated oil to said compressor sump, said oil-separating means comprising:

a closed canister having a cylindrical wall of heat conductive construction and an open internal volume, a refrigerant coil mounted on said wall externally of said canister in heat exchange relationship with said wall, a vapor inlet and a vapor outlet in an upper portion of said canister, means connecting said compressor outlet to said condenser means through said vapor inlet, said vapor outlet and said coil means in series, an oil drain in said canister including a J-shaped tube positioned within said canister, said tube having an opening at a lower portion thereof for aspirating oil into refrigerant passing through said tube, and a valve for selectively connecting said tube to said compressor inlet for returning oil from said canister to said sump.

27. A compressor system for pumping a fluid comprising:

a compressor having an inlet, an outlet and an internal oil sump for lubricating operation of said compressor, and means connected to said compressor outlet for removing oil from fluid at said outlet, said oil-separating means comprising:

a closed canister having a cylindrical wall of heat conductive construction and an open internal volume, a fluid coil mounted on said wall externally of said canister in heat exchange relationship with said wall, a vapor inlet and a vapor outlet in an upper portion of said canister, means connecting said compressor outlet through said vapor inlet, said vapor outlet and said coil means in series, an oil drain at a lower portion of said canister, a direct open connection between said drain to said compressor inlet for returning oil from said canister to said sump, and a capillary line in said connection such that oil collected in said canister is drawn to said compressor inlet without substantial removal of refrigerant from said canister.

* * * * *